US005761762A

United States Patent [19]

Kubo

[11] Patent Number: 5,761,762

[45] Date of Patent: Jun. 9, 1998

[54] CLEANER AND BOWLING MAINTENANCE MACHINE USING THE SAME

[75] Inventor: Chikanari Kubo, Yamato, Japan

[73] Assignee: Eishin Technology Co., Ltd., Ayase, Japan

[21] Appl. No.: 566,723

[22] Filed: Dec. 4, 1995

[30] Foreign Application Priority Data

Jul. 13, 1995 [JP] Japan ..... 7-199275

[51] Int. Cl.[6] ..... A47L 7/00

[52] U.S. Cl. ..... 15/320; 15/322; 15/402

[58] Field of Search ..... 15/320, 401, 321, 15/322

[56] References Cited

U.S. PATENT DOCUMENTS

| | | | |
|---|---|---|---|
| 2,610,351 | 9/1952 | Lilly | 15/401 |
| 2,876,484 | 3/1959 | Wells | 15/401 X |
| 3,571,841 | 3/1971 | Crouser | 15/401 |
| 3,584,330 | 6/1971 | Wallin et al. | 15/401 X |
| 4,293,971 | 10/1981 | Block | 15/320 X |
| 4,856,138 | 8/1989 | Ingermann et al. | 15/320 |
| 4,937,911 | 7/1990 | Picchiette et al. | 15/320 |
| 5,184,372 | 2/1993 | Mache | 15/401 |

*Primary Examiner*—Chris K. Moore

*Attorney, Agent, or Firm*—Wood, Phillips, VanSanten, Clark & Mortimer

[57] ABSTRACT

A cleaner has a power source, a vacuum generator, a waste liquid tank and a wiper-nozzle unit. Liquids and/or contaminants may be removed by slidably moving a wiper on a flat surface to collect a mass of liquid and inserting a small-sized nozzle into the collected liquid to suck it through the nozzle when the interior of the cleaner is drawn into vacuum. Since the small-sized nozzle is located adjacent the wiper, less air will be sucked in by the cleaner when the collected liquid is sucked in by the nozzle. Therefore, the cleaner can be driven by a reduced power and also reduced in size and weight.

3 Claims, 7 Drawing Sheets

CLEANER AND BOWLING MAINTENANCE MACHINE USING THE SAME

BACKGROUND OF THE INVENTION

1. Field of the Invention

The present invention relates to an apparatus for removing contaminants and/or liquids on a flat surface. More particularly, the present invention relates to a cleaner for removing any liquid such as water, cleaning liquid, liquid wax or the like on any flat surface such as house floor, gym floor, bowling lane, pavement, rooftop or the like, and a bowling maintenance machine including such a cleaner as a component.

2. Description of the Prior Art

To remove the liquid on the flat surface, the prior art has used a floorcloth or mop for wiping it away (see FIG. 11) or a rubber wiper (see FIG. 12) or a vacuum cleaner.

However, the floorcloth or mop was frequently incomplete to wipe the liquid away from the flat surface. It was further required to dry the wiped surface. With the rubber wiper, the liquid could be sufficiently wiped away, but it was difficult to handle the removed liquid (see FIG. 12). The vacuum cleaner is more effective to remove the liquid and does not require the drying after removal of the liquid. However, the vacuum cleaner requires very large power to suck the liquid with much more surrounding air and contaminants. Therefore, many vacuum cleaners required their own large capacity batteries mounted thereon when they were of stand-alone structure.

The bowling lane maintenance machines of the prior art were of a type that a vacuum cleaner was applied to remove a cleaning liquid on a bowling lane (see FIG. 13) and of another mop type (see FIG. 14).

Referring to FIG. 13, the vacuum cleaner type bowling lane maintenance machine comprises a cleaner including a vacuum (negative pressure) generator. The cleaning liquid is sprayed out through a spray nozzle 64 and then sucked in through a suction nozzle 65 in the same manner as in the conventional vacuum cleaners. The suction nozzle 65 has an elongated opening which extends across the entire width of a bowling lane to suck all the liquid on that bowling lane. Since the bowling lane maintenance machine cannot obtain an external power source, it has its own battery mounted thereon. For example, the machine shown in FIG. 13 may include two 12-volt batteries connected in series to each other, each of these batteries having a dimension of 200 mm×300 mm and a weight equal to 35 Kg. Thus, it cannot avoid that the bowling lane maintenance machine itself becomes larger and heavier. Each time when the bowling lane maintenance machine was to be transported from one location to another, the batteries would be removed from the machine.

Referring next to FIG. 14, the mop type bowling lane maintenance machine includes a cleaning liquid application roller 48. After applied to the lane, the cleaning liquid is wiped away by a wiping towel 66 which is in turn retrieved by a takeup roller 67. Such a mop type machine does not require any large capacity battery, but becomes insufficient to remove the cleaning liquid. In addition, the lane must be dried after the cleaning liquid has been wiped away therefrom.

SUMMARY OF THE INVENTION

It is therefore an object of the present invention to provide a cleaner for removing liquids and/or contaminants on a flat surface, which can sufficiently remove the liquids and/or contaminants from the flat surface without subsequent drying and which can be actuated by a smaller power.

Another object of the present invention is to provide a bowling lane maintenance machine including such a cleaner as a component.

To this end, the present invention provides a cleaner comprising a combination of a suction nozzle with a rubber plate-like wiper. The suction nozzle is adapted to suck the liquid through its inlet port under vacuum as in the conventional vacuum cleaners.

When the wiper is brought into contact with a flat surface to be cleaned, the inlet port of the suction nozzle is positioned adjacent but spaced away from both the surface and wiper. More particularly, this can be accomplished when the distance between the flat surface and the inlet nozzle port is between 0.5 mm and 3 mm and the distance between the wiper edge and the inlet nozzle port is between 3 mm and 10 mm. The cross-sectional configuration of the inlet nozzle port may be a square having dimensions between about 2 mm×about 2 mm and about 5 mm×about 5 mm and most preferably equal to about 3 mm×about 3 mm.

According to the present invention, the small-dimension nozzle is inserted directly into a mass of liquid collected by the wiper, unlike the principle of the conventional vacuum cleaners for sucking the liquid with much air. Since the cleaner of the present invention is adapted to suck the cleaning liquid through the small-dimension nozzle as in the conventional straws, it does not require any nozzle of increased dimensions and can minimize the amount of air to be sucked with the cleaning liquid.

The cleaner of the present invention may comprise a power source, a vacuum generator, a waste liquid tank and a wiper-nozzle unit. The wiper-nozzle unit may be a unitized combination of a rubber plate-like wiper with a nozzle located adjacent the wiper on one side.

In such an arrangement, the wiper is brought into contact with a flat surface to be cleaned under an appropriate pressure while slidably moving on the flat surface in a direction toward the nozzle. The liquid collected by the wiper is sucked and removed through the nozzle.

In the prior art, it is conventional that the wiper is inclined relative to a flat surface to be cleaned with an acute angle. According to the present invention, however, the angle of the inclined wiper may be obtuse. In such a case, the edge of the wiper can always be maintained at an angle equal to about 90 degrees to remove the cleaning liquid in the effective manner even if the wiper has been worn.

The cleaner of the present invention may comprise a hand grip, a single plate-like wiper and a nozzle plate including a plurality of nozzles arranged along one side of the wiper. This facilitates to carry the cleaner.

The cleaner of the present invention may be incorporated into a bowling lane maintenance machine to remove the cleaning liquid from the bowling lane. In such a case, the wiper may be in the form of a single rubber plate having a length substantially equal to the transverse width of a lane to be cleaned. A plurality of nozzle units may be arranged along the length of the wiper on one side. The wiper and nozzle units form the aforementioned wiper-nozzle unit.

The inlet port of each of the nozzles may be located very adjacent the edge of the wiper. More particularly, the inlet nozzle port must be spaced away from the wiper such that the nozzle port will not be brought into contact with the lane even if a vibration is more or less produced when the machine is moved on the lane. If such requirements are satisfied, it is desirable that the inlet nozzle port is located as near the wiper as possible.

More particularly, when the wiper is seated on the lane surface, the inlet nozzle port may be spaced away from the lane surface by a distance between 5 mm and 3 mm (and more desirably between 1 mm and 2 mm) and also from the edge of the wiper by a distance between 3 mm and 10 mm.

To maintain the distance between the wiper-nozzle unit and the lane surface constant, the wiper-nozzle unit may include wiper-nozzle unit wheels. To assist the wiper urged against the lane surface, part of the wiper may be in intimate contact with a leaf spring. It is further preferable that the cleaner includes means for raising and lowering the wiper-nozzle unit. Thus, the wiper-nozzle unit can be seated on the bowling lane when the lane is being cleaned and/or the cleaning liquid is being removed and spaced away from the lane when these operations have terminated.

DETAILED DESCRIPTION OF THE PREFERRED EMBODIMENTS

First Embodiment

Figure 1:
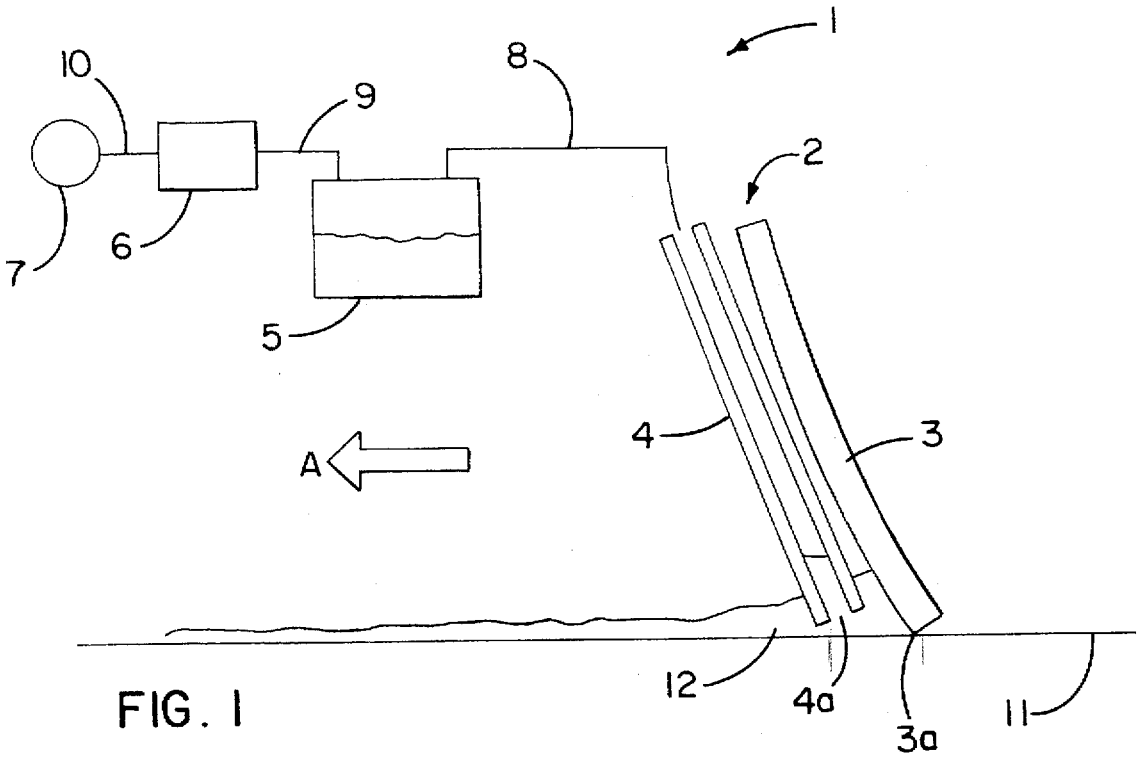
FIG. 1 is a schematic view of one embodiment of a cleaner constructed in accordance with the present invention.

Referring first to FIG. 1, the present invention provides a cleaner which comprises a wiper-nozzle unit 2, a waste liquid tank 5, a vacuum generator 6, a power supply 7 and connecting pipes 8, 9 and 10 for connecting the above component to one another.

The wiper-nozzle unit 2 includes a wiper 3 and a nozzle 4. When the wiper edge 3*a* of the wiper is brought into contact with a floor 11, the nozzle 4 has its inlet port 4*a* opened toward and located very adjacent the floor 11. At this time, the distance between the floor and the inlet nozzle port may be between about 1 mm and about 2 mm. The distance between the inlet nozzle port 4*a* and the wiper edge 3*a* may be between about 3 mm and about 10 mm. The cross-sectional configuration of the inlet nozzle port 4*a* may be a square having its dimensions preferably between about 2 mm×about 2 mm and about 5 mm×about 5 mm and most preferably about 3 mm×about 3 mm.

The wiper 3 may be formed of any one of various rubber materials. The nozzle 4 may be formed of any material. It is however required that both the wiper and nozzle 3, 4 are formed of a material which cannot be dissolved or altered by at least a liquid to be removed according to the present invention.

A mass of liquid 12 spreading on the flat floor 11 is collected by the wiper 3 in a direction of arrow A. The collected liquid 12 is sucked in through the inlet nozzle port 4*a* when a vacuum or negative pressure is produced within the cleaner 1 by the vacuum generator 6, as in the conventional vacuum cleaners. The sucked liquid is fed to the waste liquid tank 5 through the nozzle 4 via the connecting pipe 8. The waste liquid tank 5 can be removed from the machine for discarding the accumulated liquid therein.

The waste liquid tank 5, vacuum generator 6, connecting pipes 8, 9 and nozzle 4 form an internal space closed except at the inlet nozzle port 4*a* and the outlet 10 to the power supply 7. The power supply 7 and connecting pipe 10 are similar to those of the conventional vacuum cleaners.

In the cleaner 1 of the first embodiment, the inlet nozzle port 4*a* is located adjacent the wiper edge 3*a* and the dimensions of the inlet nozzle port 4*a* is relatively small. Therefore, the nozzle 4 can only suck the collected liquid around the wiper 3 with the minimized amount of surrounding air. Therefore, the cleaner of the present invention only requires less power than those of the conventional vacuum cleaners. If a battery is used as a mounted power supply, it can be of a capacity smaller than those of the prior art.

Figure 2:
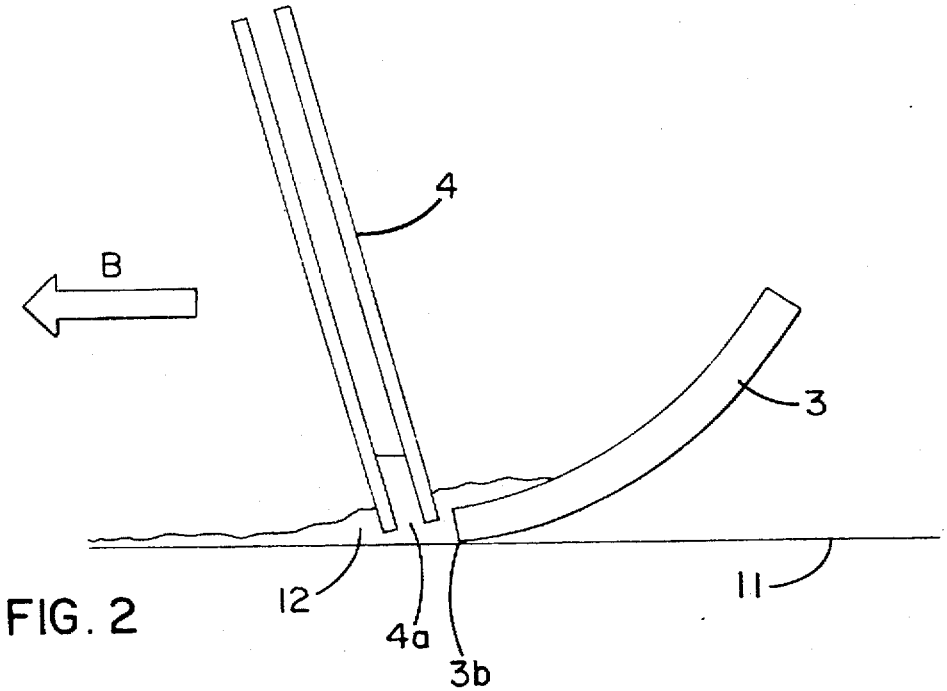
FIG. 2 is a schematic view of another embodiment of a cleaner constructed in accordance with the present invention.

The wiper may be inclined relative to a direction of advance B by an obtuse angle as shown in FIG. 2 when the collected liquid is wiped away by the wiper. In such a case, the wiper edge 3*b* can be maintained at an angle substantially equal to 90 degrees even when the wiper 3 has been worn. Therefore, the collected liquid can be more effectively wiped away and removed by the wiper 3.

Second Embodiment

Figure 3:
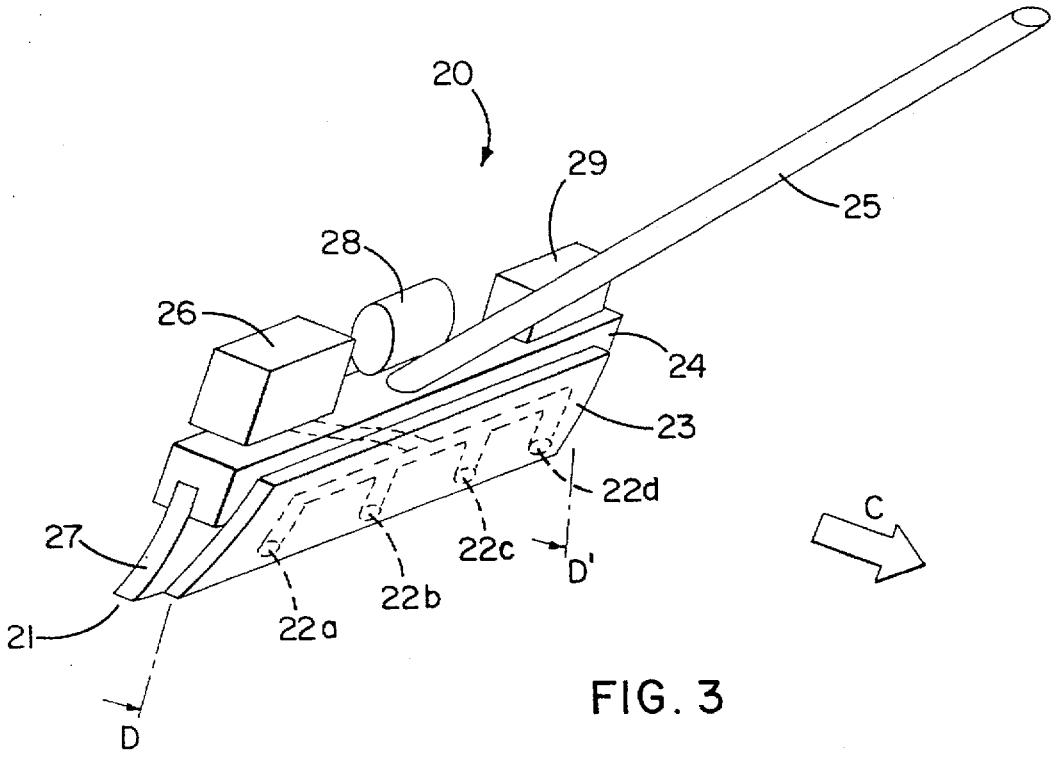
FIG. 3 is a perspective view of still another embodiment of a cleaner constructed in accordance with the present invention.
Figure 4:
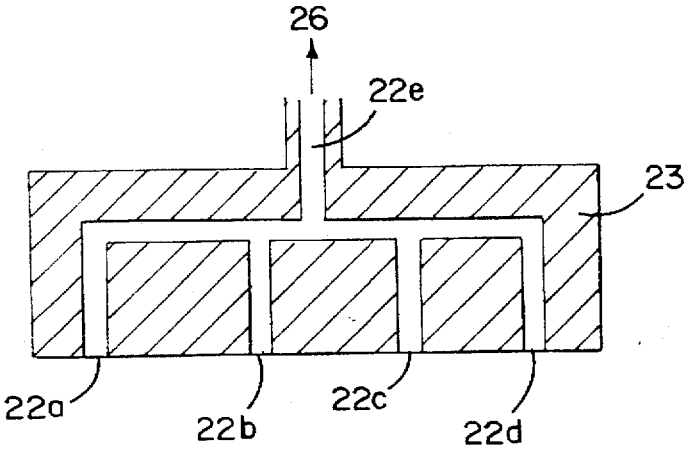
FIG. 4 is a cross-sectional view of the nozzle, taken along a line D–D' in FIG. 3.

A wiper unit type cleaning instrument 20 to which the cleaner of the present invention is applied is shown in FIGS. 3 and 4. The wiper unit type cleaning instrument 20 comprises a holder 24 having a hand grip 25, a wiper 27 mounted on the holder 24 and a nozzle plate 23 similarly mounted on the holder 24. The bottom of the nozzle plate 23 is formed with four inlet ports 22*a*, 22*b*, 22*c* and 22*d*.

As shown in FIG. 4, the four inlet nozzle ports 22*a*, 22*b*, 22*c* and 22*d* are connected together to a nozzle manifold 22*e* which is in turn connected to a waste liquid tank 26. The waste liquid tank 26 is removable from the machine for discarding the waste liquid accumulated therein.

The wiper unit type cleaning instrument 20 is slidably moved on a flat surface in a direction of arrow C through the hand grip 25 grasped by an operator to remove the spreading liquid on the flat surface. More particularly, the wiper 27 wipes the liquid and the vacuum generator 28 is then energized by the power from a battery 29 to suck the liquid collected forward of the moved wiper 27 in the direction of arrow C through the inlet nozzle ports 22*a*, 22*b*, 22*c* and 22*d*. The sucked liquid is once gathered in the nozzle manifold 22*e* and then fed to the waste liquid tank 26.

Third Embodiment

A wiper nozzle type bowling lane maintenance machine 30 to which the cleaning instrument of the present invention is applied is schematically shown in FIGS. 5 to 10.

Figure 14:
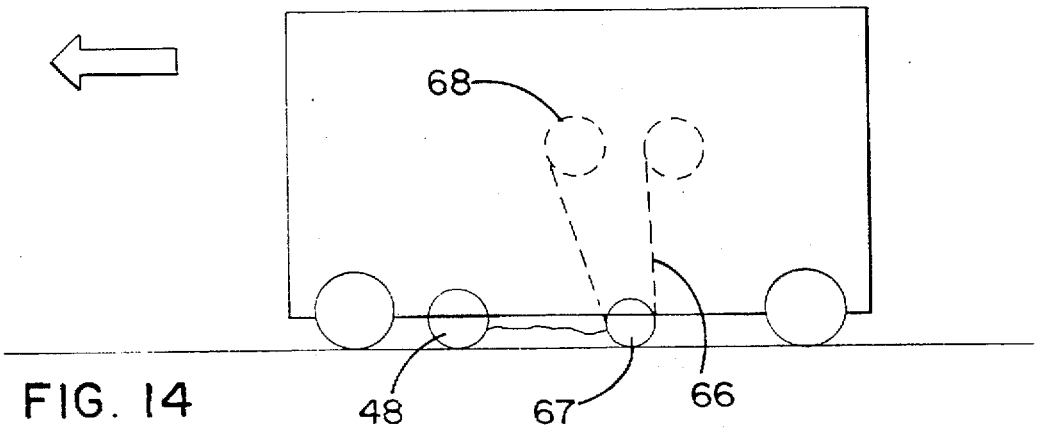
FIG. 14 is a side view of another cleaner constructed in accordance with the prior art.

The wiper nozzle type bowling lane maintenance machine 30 comprises a wiper-nozzle unit 31 for removing the cleaning liquid, in place of a wiping towel 66, takeup roller 67 and wiping roller 68 in a mop type bowling lane maintenance machine of the prior art shown in FIG. 14.

Figure 5:
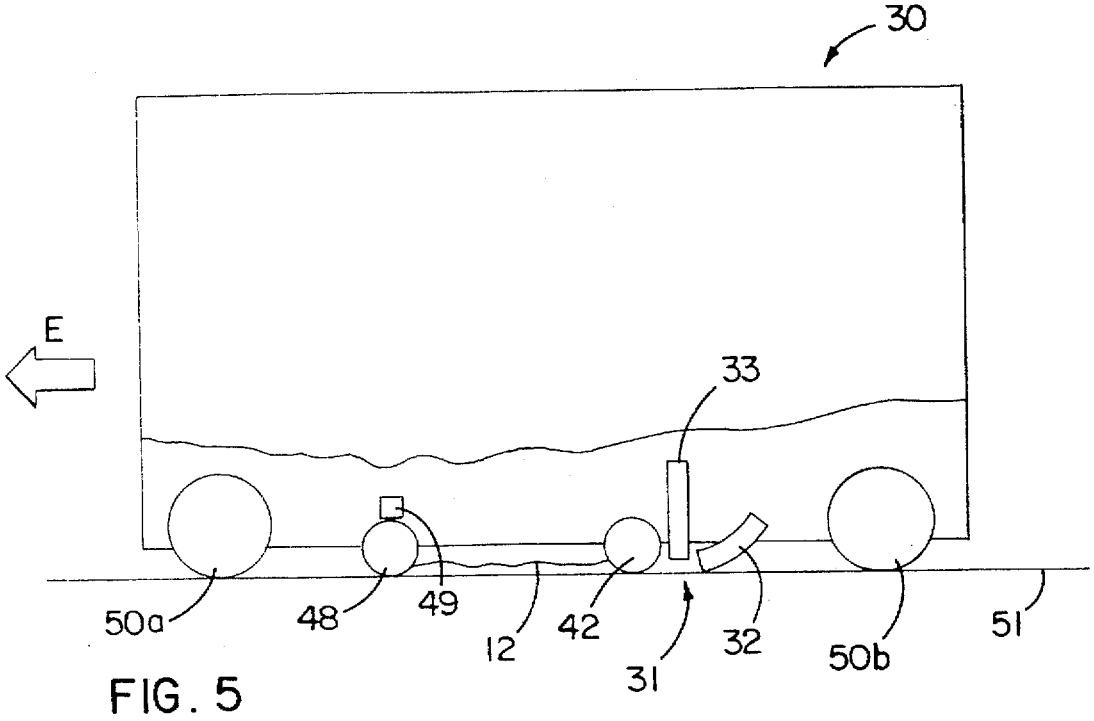
FIG. 5 is a schematic side view of a further embodiment of a cleaner constructed in accordance with the present invention.
Figure 6:
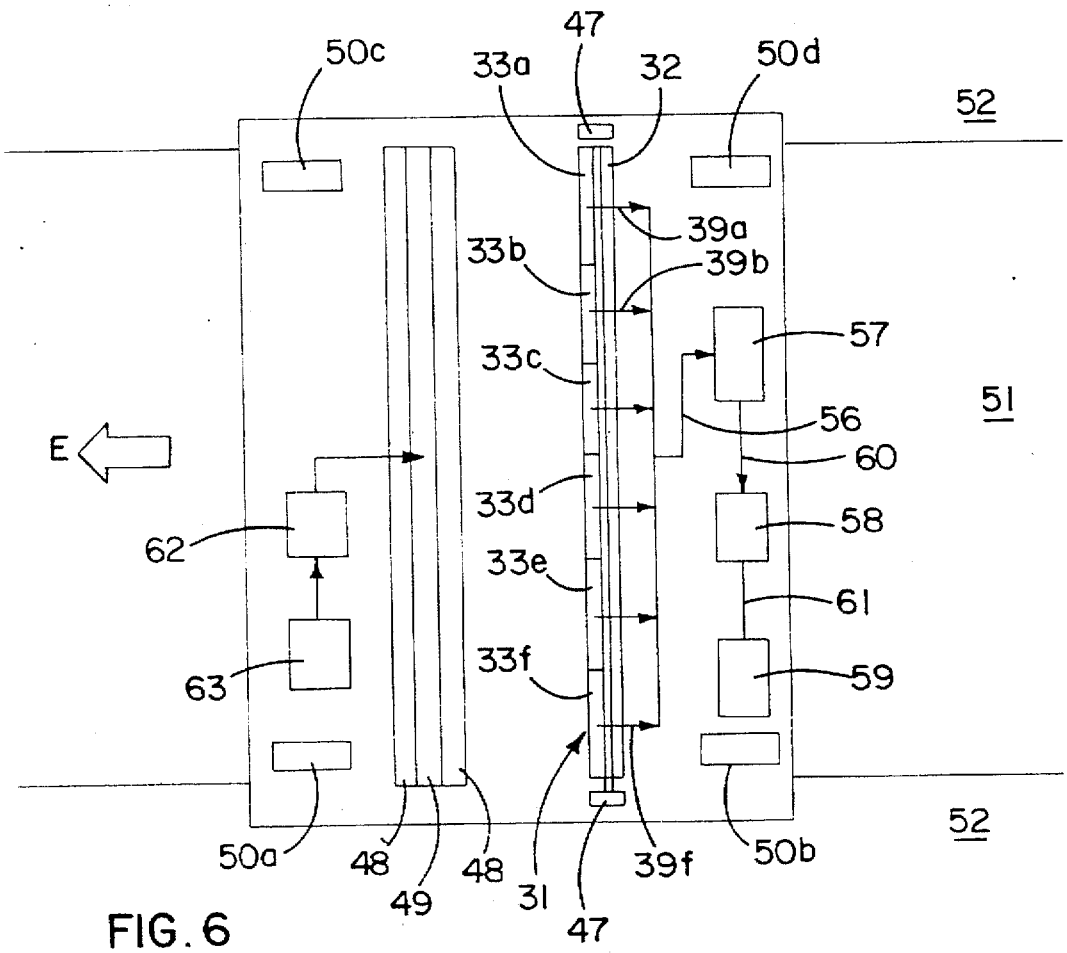
FIG. 6 is a schematic top view, partially broken away, of a further embodiment of a cleaner constructed in accordance with the present invention.
Figure 7:
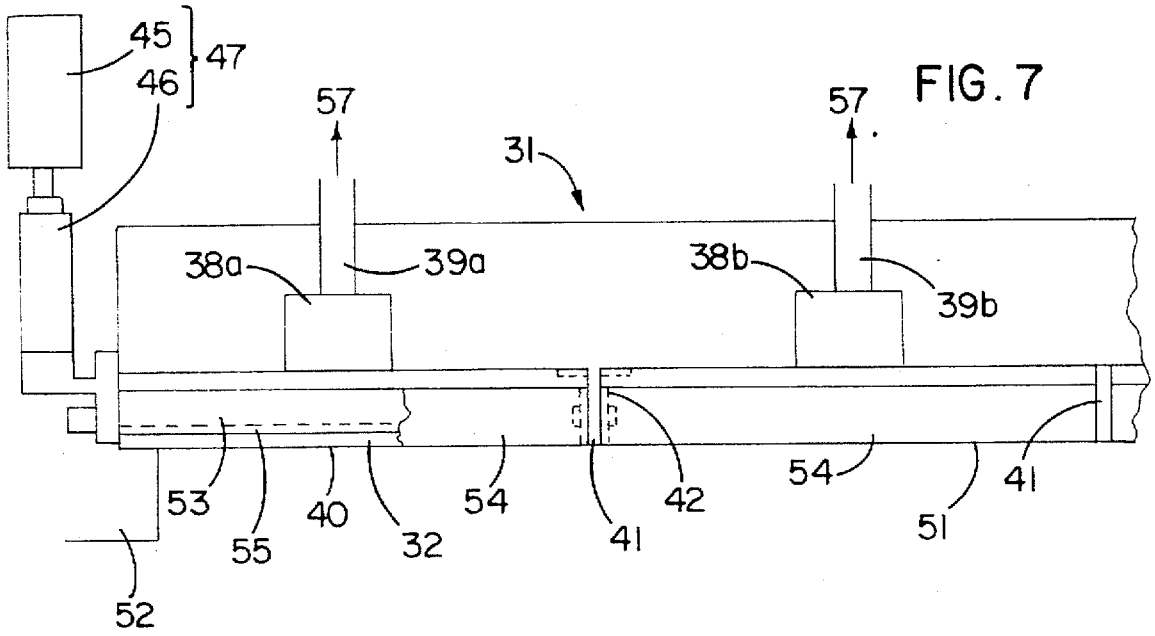
FIG. 7 is a fragmentary view, partially broken away, of a further embodiment of a cleaner constructed in accordance with the present invention.

The wiper-nozzle unit 31 shown in FIGS. 5 and 6 comprises a wiper 32, six nozzle units 33, six suction tubes 39 connected to the respective nozzle units 33 and a wiper-nozzle unit drive means 47.

The wiper 32 is defined by a single rubber plate having a length substantially equal to the entire transverse width of a bowling lane. The wiper 32 is connected to the respective nozzle units 33 through mounting shafts 55 (FIG. 8) and wiper locking members 54. The entire length of the wiper 32 is in intimate contact with a leaf spring 53. The leaf spring 53 functions to bias the wiper 32 against the floor under constant pressure. The nozzle plates 34, and associated header joints 38 and mounting shafts 55, are attached to and supported by a rigid generally S-shaped member 60 extending parallel to the wiper 32, seen best in FIGS. 7 and 8.

Figure 8:
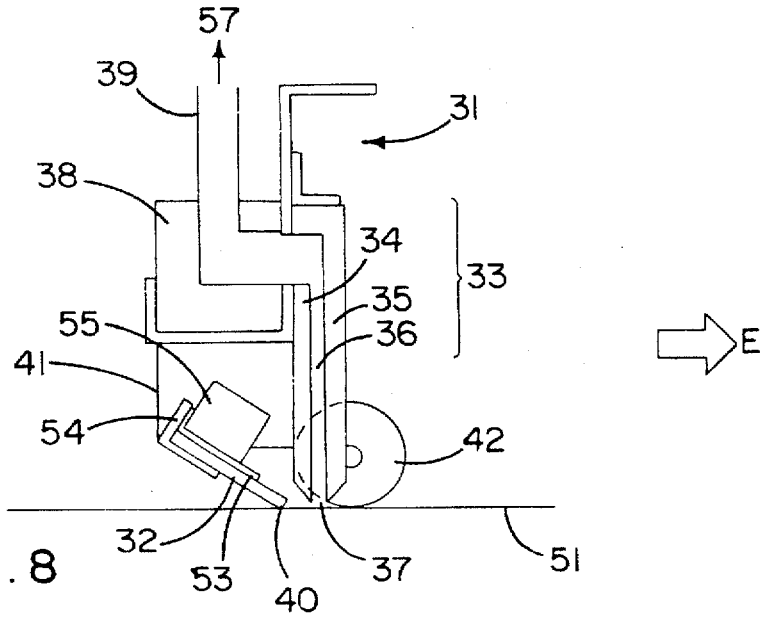
FIG. 8 is a schematic side view of a further embodiment of a cleaner constructed in accordance with the present invention.
Figure 10:
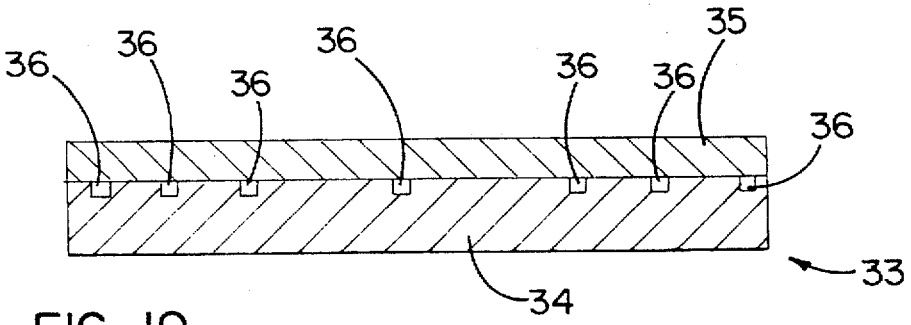
FIG. 10 is a cross-sectional view of the nozzle, taken along a line F–F' in FIG. 9.
Figure 11:
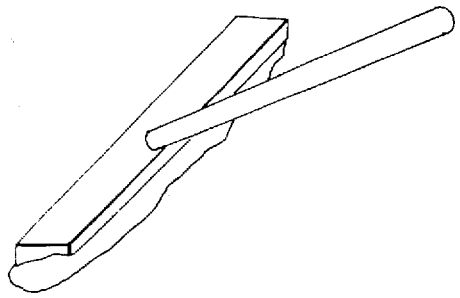
FIG. 11 is a perspective view of a cleaning device according to the prior art.
Figure 12:
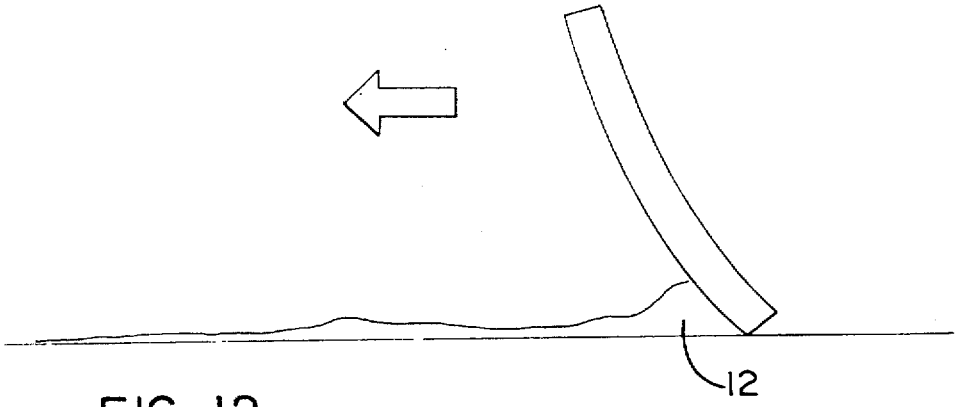
FIG. 12 is a view illustrating the prior art.
Figure 13:
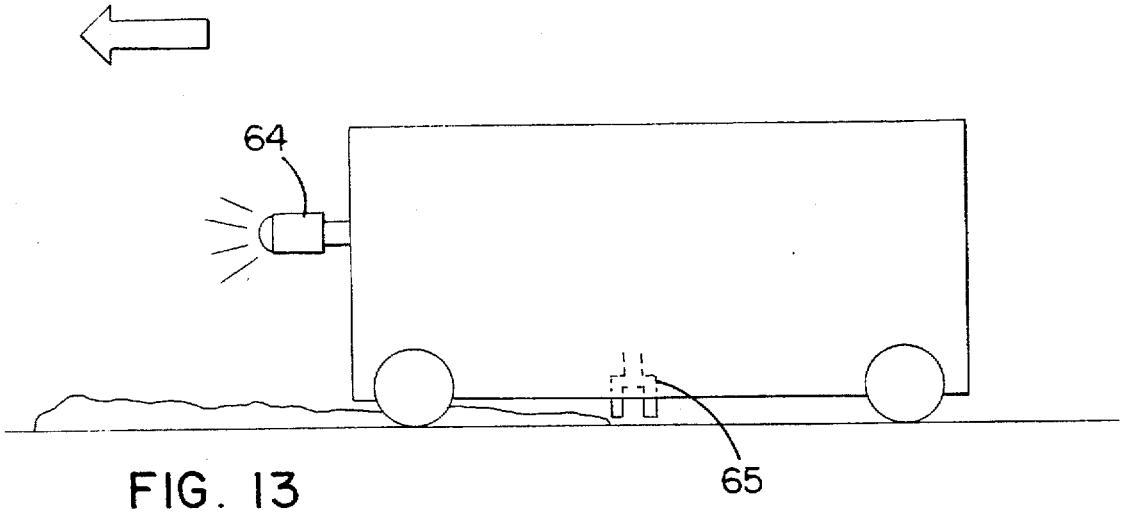
FIG. 13 is a side view of a cleaner constructed in accordance with the prior art.

The upper edge of the wiper 32 includes a plurality of T-shaped support metals 41 spaced away from one another. These support metals 41 function to prevent the central portion of the wiper 32 from being upwardly flexed when the opposite ends of the wiper-nozzle unit 31 are urged against to a bowling lane 51 under the action of the wiper-nozzle unit drive means 47 Each of the nozzle units 33 is formed by two nozzle plates 34 and 35 spaced away from each other, which nozzle plates form a liquid passage 36 opened at the bottom of the nozzle unit 33 to form an inlet port 37 (FIGS. 8 and 10).

Each of the nozzle units 33 includes an upper joint or header 38 to which the liquid passages 36 are connected and which is in turn connected to an upper tube 39. The tube 39 is connected to a waste liquid tank 57 through a connection pipe 56 (FIGS. 6 and 8).

The six nozzle units 33 are arranged in line adjacent the wiper 32. A wiper-nozzle unit wheel 42 is located between one of the nozzle units 33*a* and the adjacent nozzle unit 33*b* (see FIGS. 7 and 8). Another wiper-nozzle unit wheel (not shown) is located at a position opposite to the first-mentioned wiper-nozzle unit wheel 42 about a central machine axis parallel to the direction of movement of the bowling lane maintenance machine. These two wiper-nozzle unit wheels 42 function to maintain the distance between the wiper-nozzle unit 31 and the lane 51 exactly constant.

The wiper-nozzle unit drive means 47 includes two drives mounted on the wiper-nozzle unit 31 at the opposite ends. Each of these drives comprises a vertical drive cylinder 45 and a wiper-nozzle unit guide 46 (see FIGS. 6 and 7).

Figure 9:
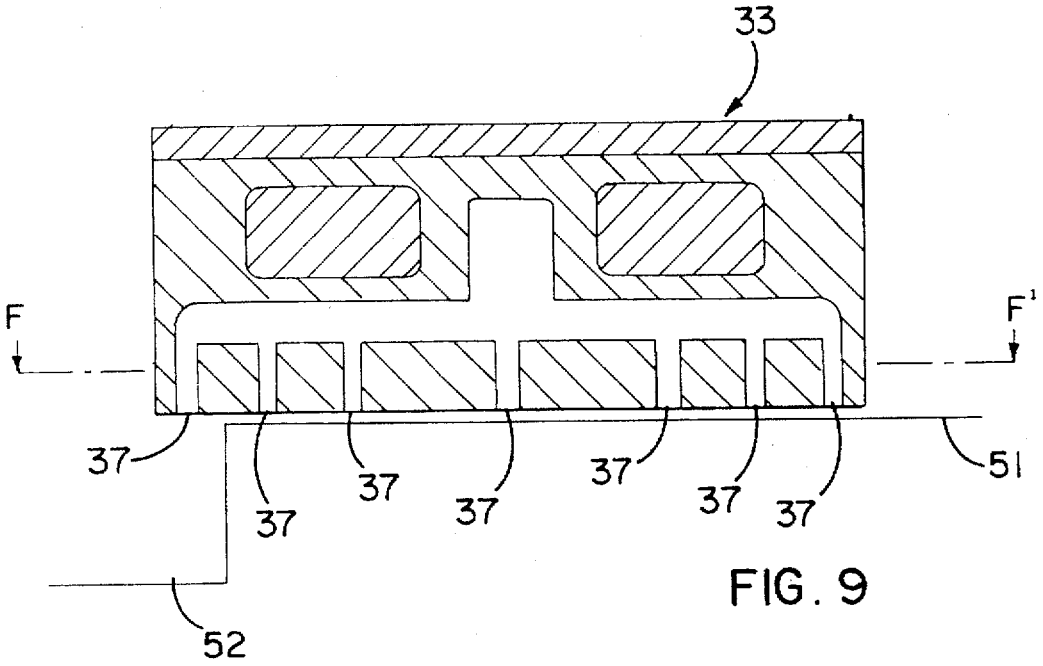
FIG. 9 is a cross-sectional view of a further embodiment of the nozzle usable in the present invention.

Referring now to FIGS. 9 and 10, the bottom of each of the nozzle units 33 includes seven inlet ports formed therein and arranged in line along the wiper. The seven inlet ports are formed in the central portion of the nozzle unit 33 with increased intervals and in the opposite ends thereof with reduced intervals. Thus, the liquid collected in the boundaries between the nozzle units 33*a* and 33*b* and between the nozzle units 33*b* and 33*c* can also be sucked through these nozzle units in a more effective manner.

The wiper-nozzle type bowling lane maintenance machine 30 operates as follows:

When the bowling lane 51 is to be cleaned by the wiper nozzle type bowling lane maintenance machine 30, ground wheels 50*a*, 50*b*, 50*c* and 50*d* thereof are driven to move the machine 30 on the lane 51 in a direction of arrow E (also see FIGS. 5, 6 and 8).

The cleaning liquid is applied to the bowling lane in the same manner as in the conventional wiping type bowling lane maintenance machines. More particularly, the cleaning liquid is fed from a cleaning liquid tank 63 to a cleaning liquid nozzle 49 through a pump 62. After the cleaning liquid has been discharged from the cleaning liquid nozzle 49, it is wiped and applied to the lane 51 by a cleaning liquid application roller 48.

After application of the cleaning liquid, the wiper-nozzle unit 31 is lowered to seat the wiper 32 on the lane by the wiper-nozzle unit drive means 47. The wiper 32 is urged against the lane 51 under an appropriate pressure and moved in the direction of arrow E. Thus, the cleaning liquid is wiped away and removed with any contaminant thereon being removed together. At the same time, the vacuum generator 58 produces a vacuum in the interior of the waste liquid tank 57, connection pipes 56, 60, tubes 39 and joints 38. The cleaning liquid gathered adjacent the wiper 32 in the direction of arrow E is sucked up through the inlet nozzle ports 37. At this time, the distance between the inlet nozzle ports 37 and the lane surface is between about 1 mm and about 2 mm while the distance between the inlet nozzle ports 37 and the wiper edge 3*a* is between about 3 mm and about 10 mm. The cleaning liquid sucked by the nozzle units 33 is then fed to the waste liquid tank through the joints 38, tubes 39 and connection pipe 56. The cleaning liquid is then separated into liquid and air phases within the waste liquid tank 56 through any suitable separation means. Therefore, any liquid phase will not flow into the vacuum generator 58.

On termination of the cleaning and liquid removing operations, the wiper-nozzle unit drive means is reversely actuated to move the wiper-nozzle unit upwardly and to separate the wiper 32 from the lane 51.

In the wiper nozzle type bowling lane maintenance machine 30, the inlet nozzle ports 37 are located adjacent the wiper 32 and the dimensions of the nozzles are relatively small. Therefore, only the cleaning liquid accumulated adjacent the wiper can be sucked in by the nozzles with very small quantity of surrounding air being sucked in. Therefore, the machine 30 can use a small-sized battery mounted thereon. For example, the weight thereof may be equal to about 15 Kg. Two DC 12-volt batteries are preferably connected in series to each other. As a result, the wiper nozzle type bowling lane maintenance machine 30 of the present invention can be reduced in size and weight, in comparison with the bowling lane maintenance machines of the prior art using the conventional vacuum cleaners.

The cleaner of the present invention can effectively remove the liquids and/or contaminants from the flat surface since the latter is reliably wiped out by the edge of the wiper. This can be accomplished by a smaller power. Therefore, the cleaner can be reduced in size and weight since a battery of smaller capacity can be mounted in the cleaner.

I claim:

1. A cleaner for removing a liquid from a flat surface, comprising a power source, a vacuum generator, a waste liquid tank and a wiper-nozzle unit comprising a rubber plate-like wiper means having a lower edge for wiping liquid from the flat surface and inlet nozzle port means for sucking liquid from the flat surface, said inlet nozzle port means being located adjacent one side of the wiper means, passage means connecting the vacuum generator, the waste liquid tank and the inlet nozzle port means whereby liquid is sucked through the inlet nozzle port means into the waste liquid tank, said inlet nozzle port means being spaced away from but adjacent said flat surface and the lower edge of the wiper means being positioned against the flat surface from which the liquid is to be removed, wherein the inlet nozzle port means for sucking the liquid from the flat surface comprises a plurality of linearly arrayed inlets located within 1 to 4 mm of the flat surface from which the liquid is to be removed, and said wiper means is inclined relative to the flat surface, and wherein the angle included between the flat surface and the other side of the wiper means remote from said inlet nozzle port means is acute.

2. A cleaner for removing a liquid from a flat surface, comprising a power source, a vacuum generator, a waste liquid tank and a wiper-nozzle unit comprising a rubber plate-like wiper means having a lower edge for wiping liquid from the flat surface and inlet nozzle means for sucking liquid from the flat surface, said inlet nozzle means being located adjacent one side of the wiper means, passage means connecting the vacuum generator, the waste liquid tank and the inlet nozzle means whereby liquid is sucked through the inlet nozzle means into the waste liquid tank, said inlet nozzle means being spaced away from but adjacent said flat surface and the lower edge of the wiper means being positioned against the flat surface from which the liquid is to be removed, the cleaner further comprising a hand grip and wherein said wiper means is in the form of a plate-like member, said inlet nozzle means being in the form of a nozzle plate on the bottom of which a plurality of inlet nozzle ports are open and arranged along said wiper means, said inlet nozzle ports being connected to a single connection passage within said nozzle plate, said connection passage being then connected to said waste liquid tank.

3. A bowling lane maintenance machine comprising, as means for removing the cleaning liquid from a bowling lane, a cleaner for removing a liquid from a flat surface, said cleaner comprising a power source, a vacuum generator, a waste liquid tank and a wiper-nozzle unit comprising a rubber plate-like wiper having an edge and inlet nozzle means located adjacent one side of the wiper, passage means connecting the vacuum generator, the waste liquid tank, and the inlet nozzle means whereby liquid is sucked through the inlet nozzle means into the waste liquid tank, said inlet nozzle means being spaced away from but adjacent said flat surface and the edge of the wiper when said inlet wiper-nozzle unit is located upon the flat surface from which the liquid is to be removed by said bowling lane maintenance machine, said wiper being in the form of a plate-like member, said inlet nozzle means being in the form of a nozzle plate on the bottom of which a plurality of inlet nozzle ports are open and arranged along the edge of said wiper, said inlet nozzle ports being connected to a single connection passage within said nozzle plate, said connection passage being then connected to said waste liquid tank, said inlet nozzle ports being located adjacent the flat surface from which the liquid is to be removed by the edge of said wiper, said wiper being inclined relative to the flat surface.

* * * * *